US012466691B2

(12) United States Patent
Shimozawa et al.

(10) Patent No.: US 12,466,691 B2
(45) Date of Patent: Nov. 11, 2025

(54) KINK PREVENTION JIG AND PAIL PACK

(71) Applicant: KOBE STEEL, LTD., Kobe (JP)

(72) Inventors: Ryota Shimozawa, Kanagawa (JP); Koji Sato, Kanagawa (JP)

(73) Assignee: KOBE STEEL, LTD., Kobe (JP)

( * ) Notice: Subject to any disclaimer, the term of this patent is extended or adjusted under 35 U.S.C. 154(b) by 357 days.

(21) Appl. No.: 18/044,251

(22) PCT Filed: Sep. 3, 2021

(86) PCT No.: PCT/JP2021/032559
§ 371 (c)(1),
(2) Date: Mar. 7, 2023

(87) PCT Pub. No.: WO2022/054732
PCT Pub. Date: Mar. 17, 2022

(65) Prior Publication Data

US 2023/0331512 A1 Oct. 19, 2023

(30) Foreign Application Priority Data

Sep. 9, 2020 (JP) ..... 2020-151376

(51) Int. Cl.
*B65H 57/18* (2006.01)
*B65D 85/04* (2006.01)
*B65H 49/08* (2006.01)

(52) U.S. Cl.
CPC ..... *B65H 57/18* (2013.01); *B65D 85/04* (2013.01); *B65H 49/08* (2013.01)

(58) Field of Classification Search
CPC ..... B65D 85/04; B65D 85/02; B65H 57/18
See application file for complete search history.

(56) References Cited

U.S. PATENT DOCUMENTS 2,629,566 A 2/1953 King
2,905,409 A * 9/1959 Sheldon ..... H01F 41/096 242/128
2011/0155739 A1* 6/2011 Arita ..... B65H 57/18 220/694

FOREIGN PATENT DOCUMENTS

JP 57-18556 U 1/1982
JP 2011-136346 A 7/2011
JP 5198424 B2 5/2013

OTHER PUBLICATIONS

International Search Report and Written Opinion issued Nov. 22, 2021 in PCT/JP2021/032559 filed Sep. 3, 2021, 6 pages.

* cited by examiner

*Primary Examiner* — Javier A Pagan
(74) *Attorney, Agent, or Firm* — Oblon, McClelland, Maier & Neustadt, L.L.P.

(57) ABSTRACT

A kink prevention jig used in a pail pack to prevent kinks when wire is pulled out is provided with a housing that has a base plate part and a tubular outer tube part, and that accommodates a laminated wire and a wire extraction hole thereabove. This kink prevention jig is provided with an outwardly extended section above the laminated wire and that extends in the radial direction of the outer tube part, and a wire abutment section above the outwardly extended section and which abuts on a welding wire W and thereby prevents kinks when the welding wire W is pulled out from the extraction hole.

10 Claims, 11 Drawing Sheets

KINK PREVENTION JIG AND PAIL PACK

TECHNICAL FIELD

The present invention relates to a kink prevention jig and a pail pack.

BACKGROUND ART

In recent years, automation and robotization of welding are progressing. Therefore, there is a large demand for lengthening a welding wire such as a solid wire for MAG welding and a flux-cored wire for MAG welding, and use of a pail pack containing a laminated welding wire is increasing. However, with the pail pack, when welding is continuously performed, the welding wire is twisted near an outlet of the pail pack, causing a kink and stopping withdrawal of the welding wire. Since the occurrence of the kink causes a decrease in an operation rate in robot welding or the like, it is required to prevent the kink.

Patent Literature 1 describes a pail pack in which an inner cylinder and an outer cylinder are coaxially disposed on a bottom plate of the pail pack, a welding wire laminated in a coil shape is accommodated between the inner cylinder and the outer cylinder, and a pressing member is placed on the coil-shaped welding wire. In the pail pack, the pressing member prevents the welding wire from being entangled and knotted when the welding wire is drawn out.

CITATION LIST

Patent Literature

Patent Literature 1: Japanese Patent No. 5198424

SUMMARY OF INVENTION

Technical Problem

However, even when the pail pack described in Patent Literature 1 is used, a kink may still occur, and a further kink prevention measure is required.

The present invention has been made in view of the above-described problems, and an object of the present invention is to provide a kink prevention jig and a pail pack with which an occurrence of a kink can be prevented when a wire is drawn out.

Solution to Problem

The above object of the present invention is achieved by the following configuration (1) related to a kink prevention jig.

(1) A kink prevention jig for a pail pack, in which the pail pack includes a housing to accommodate a laminated wire and a draw-out opening for a wire at an upper side, the housing including a bottom plate portion and a cylindrical outer cylinder portion, and in which the kink prevention jig includes:

an outward extending portion provided above the laminated wire and extending in a radial direction of the outer cylinder portion; and a wire abutting portion formed above the outward extending portion so that the wire abutting portion abuts against the wire to prevent occurrence of a kink when the wire is drawn out from the draw-out opening.

According to this configuration, when the kink prevention jig is used for the pail pack, an occurrence of a kink can be prevented when the wire is drawn out.

A preferred embodiment of the kink prevention jig according to the present invention relates to the following (2) to (4).

(2) The kink prevention jig according to (1), in which a top portion of the wire abutting portion is located at a height greater than $H1+\frac{1}{2}\times(H2-H1)$, where H1 is a height of the housing and H2 is a height of the draw-out opening.

According to this configuration, since a space through which the wire passes is narrowed and the wire is guided to the vicinity of the draw-out opening, the occurrence of the kink can be prevented more reliably.

(3) The kink prevention jig according to (1) or (2), in which the pail pack includes, in the housing, an inner cylinder provided on an inner side of the laminated wire in a coil shape, and in which the kink prevention jig has a connecting portion extending downward from the outward extending portion to engage with the inner cylinder.

According to this configuration, the inner cylinder in the pail pack and the kink prevention jig can be connected, and the kink prevention jig can be disposed on the inner cylinder.

(4) The kink prevention jig according to any one of (1) to (3), in which the wire abutting portion is formed in a substantially conical shape.

According to this configuration, the wire can be smoothly guided toward the draw-out opening for the wire.

The above object of the present invention can be achieved by the following configuration (5) related to a pail pack.

(5) A pail pack including the kink prevention jig according to any one of (1) to (4).

According to this configuration, an occurrence of a kink can be prevented when the wire is drawn out from the pail pack.

A preferred embodiment of a pail pack according to the present invention relates to the following (6) and (7).

(6) The pail pack according to (5), further including:

a pressing plate configured to press the laminated wire downward, in which the pail pack is configured such that the laminated wire is drawn out in an interior drawer manner.

According to this configuration, an occurrence of a kink in an interior drawer manner pail pack can be prevented.

(7) The pail pack according to (5) or (6), further including:

a lid body provided to cover an opening portion opposite to the bottom plate portion in the housing, in which the lid body has a substantially conical shape with an outer diameter gradually decreasing upward.

According to this configuration, the wire passes through a space between the lid body and the substantially conical kink prevention jig, and thus the space through which the wire passes is narrowed, and the occurrence of the kink can be effectively prevented.

Advantageous Effects of Invention

According to the present invention, it is possible to provide a kink prevention jig and a pail pack with which an occurrence of a kink can be prevented when a wire is drawn out.

DESCRIPTION OF EMBODIMENTS

First Embodiment

Figure 1:
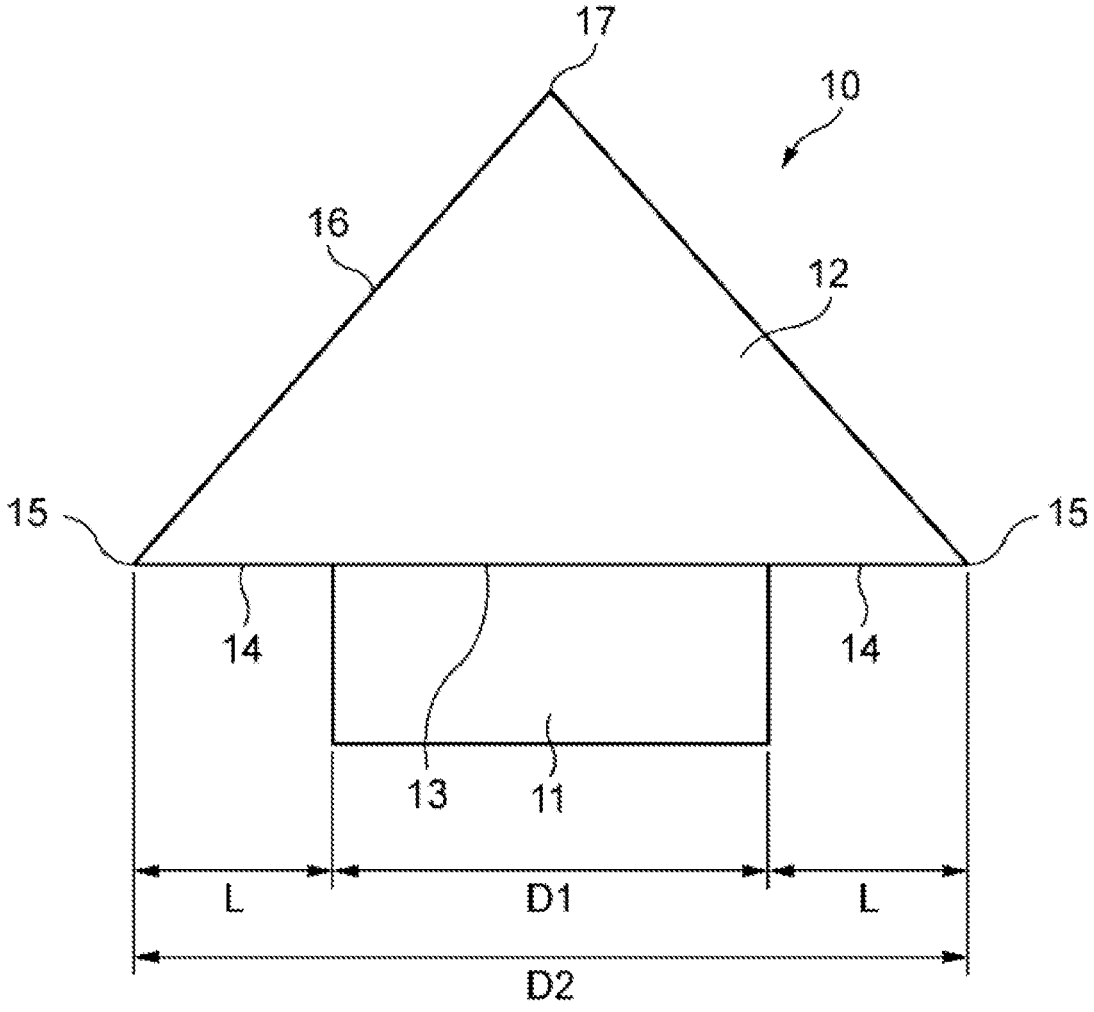
FIG. 1 is a side view showing a kink prevention jig according to an embodiment of the present invention.

Hereinafter, a kink prevention jig according to an embodiment of the present invention will be described in detail with reference to the drawings. As shown in FIG. 1, a kink prevention jig 10 according to the present embodiment includes a cylindrical portion 11 that engages with an inner cylinder 34 of a pail pack 30 shown in FIG. 3, which will be described later, and a conical portion 12 that is coaxially and integrally formed with an upper portion of the cylindrical portion 11. Here, the cylindrical portion 11 is a connecting portion that engages with the inner cylinder 34 and connects the inner cylinder 34 and the kink prevention jig 10.

A diameter D2 of a bottom surface 13 of the conical portion 12 is larger than a diameter D1 of the cylindrical portion 11. The bottom surface 13 of the conical portion 12 includes flange-shaped outward extending portions 14 extending from an upper outer peripheral portion of the cylindrical portion 11 in an outer radial direction. A length L of the outward extending portion 14 in a radial direction, the diameter D1, the diameter D2, and a height of the conical portion 12 are appropriately set according to a size of the pail pack 30 to be used. In the present embodiment, the outward extending portion 14 extends from the cylindrical portion 11 toward an outer peripheral edge 15 in a horizontal direction, but may extend obliquely downward or obliquely upward from the cylindrical portion 11 toward the outer peripheral edge 15.

In the kink prevention jig 10, the outer peripheral edges 15 of the bottom surface 13 of the conical portion 12 and a conical surface 16 of the conical portion 12, which is a wire abutting portion, abut against a welding wire W to be drawn out, thereby preventing a kink from occurring in the wire W. A shape of a generatrix forming the conical surface 16 may be straight, concave, convex, or curved, and is preferably straight or convex.

The cylindrical portion 11 and the conical portion 12 of the kink prevention jig 10 may be integrally molded solidly or hollowly, for example, with a resin or metal, or may be a frame member formed by combining a plurality of generatrix forming the outer peripheral edge 15 of the bottom surface 13 of the conical portion 12 and the conical surface 16 of the conical portion 12 with wires or the like.

The cylindrical portion 11 may be a connecting portion that engages with the inner cylinder 34 (see FIGS. 3 and 4), and may have a shape such as a quadrangular prism or a triangular prism. The inner cylinder 34 and the kink prevention jig 10 may be integrated with each other.

Figure 2A:
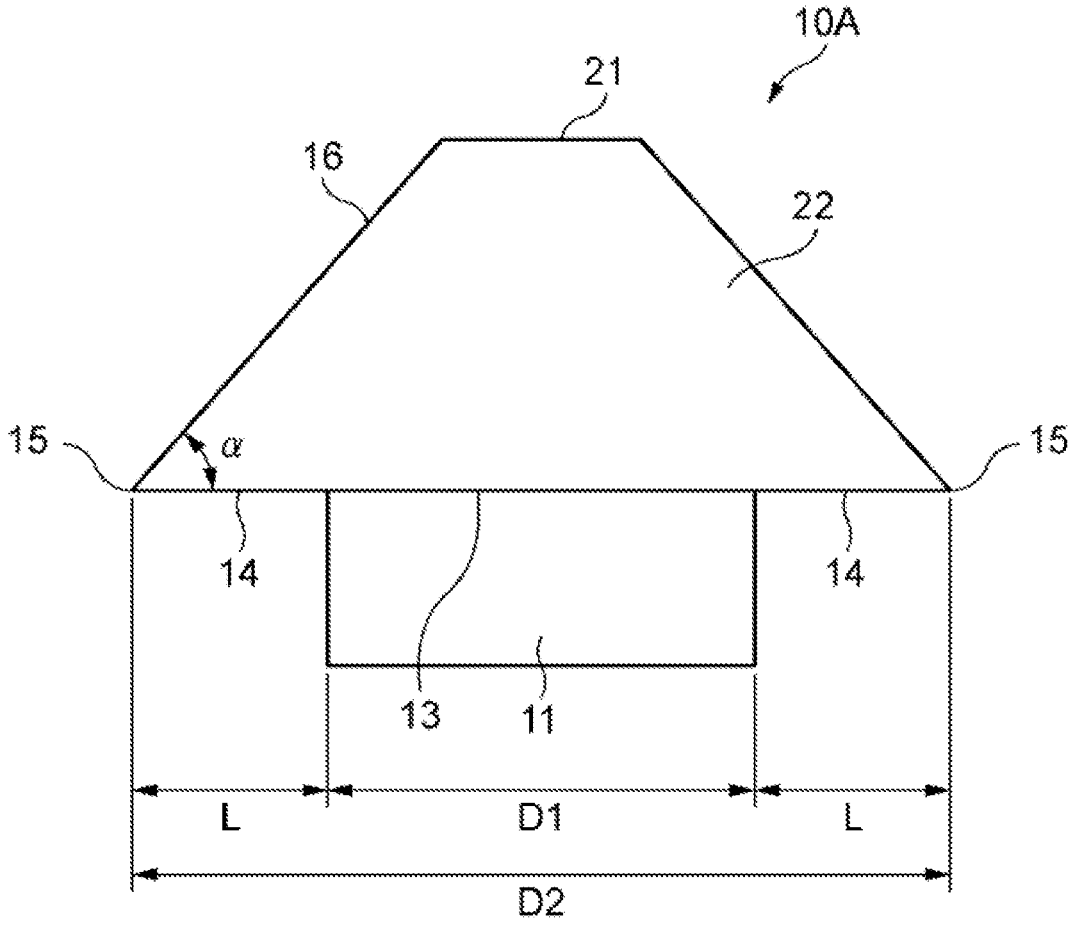
FIG. 2A is a side view showing a kink prevention jig according to one modification.

As shown in FIG. 2A, in a kink prevention jig 10A according to one modification, the conical portion 12 of the kink prevention jig 10 shown in FIG. 1 has a shape of a truncated cone 22 such that a top portion of the conical portion 12 includes a flat surface 21 formed by being cut parallel to the bottom surface 13. Other portions have shapes same as those of the kink prevention jig 10 according to the above-described embodiment, and thus detailed description thereof will be omitted. Similar to the height of the conical portion 12, a height of the truncated cone 22 is appropriately set according to the size of the pail pack 30 to be used. For example, as in a kink prevention jig 10B according to another modification shown in FIG. 2B, a height of the truncated cone 22 may be larger than that shown in FIG. 2A.

Figure 3:
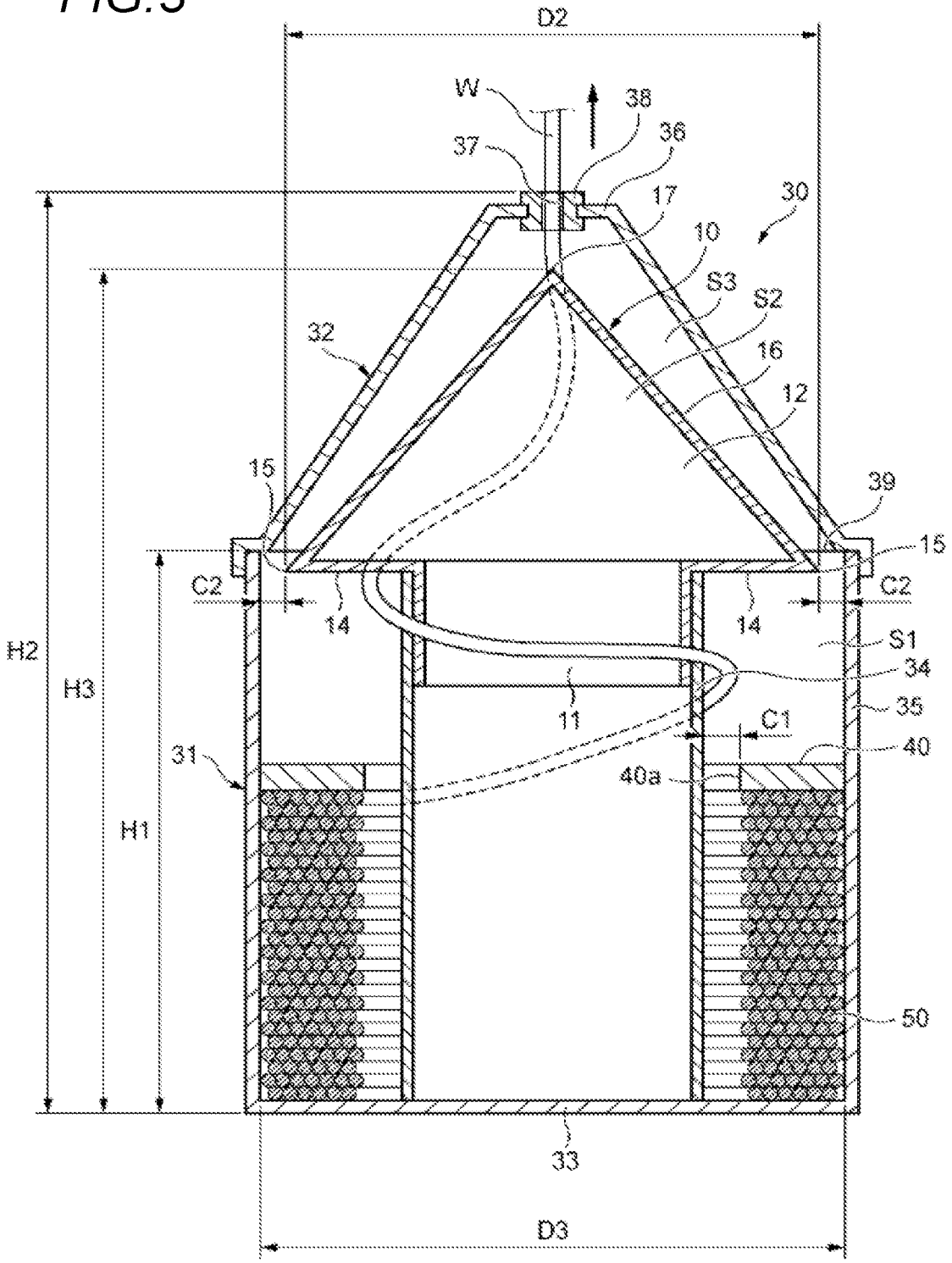
FIG. 3 is a cross-sectional view showing a pail pack according to a first embodiment of the present invention.

As shown in FIG. 3, the pail pack 30 includes a lid body 32 and a housing 31 including an outer cylinder portion 35 and a bottom plate portion 33. The lid body 32 is provided in an upper portion of the housing 31 so as to cover an opening portion 39 opposite to the bottom plate portion 33. The housing 31 includes an inner cylinder 34 and the outer cylinder portion 35 that are coaxially disposed on the bottom plate portion 33, and a laminated wire 50 formed by winding the welding wire W in a coil shape is accommodated between the inner cylinder 34 and the outer cylinder portion 35. In the present embodiment, the inner cylinder 34 and the outer cylinder portion 35 are coaxially disposed on the bottom plate portion 33, but the inner cylinder 34 and the outer cylinder portion 35 do not necessarily need to be coaxially disposed. In addition, a shape of the lid body 32 is not limited to the shape of the present embodiment, and an inclined surface of the lid body may have a concave shape or a convex shape. Shapes of the lid body 32 and the kink prevention jig 10 can be selected such that they can be used as a pail pack.

The lid body 32 is formed in a substantially truncated cone shape with an outer diameter gradually decreasing upward, and a cap 38 including a draw-out opening 37 from which the wire W is drawn out is fixed to a top portion 36 of the lid body 32. The housing 31 forms an accommodation space S1 for accommodating the laminated wire 50 therein. The lid body 32 forms a passage space S3 with the kink prevention jig 10, as will be described later. In the present embodiment, the term "upward" means a vertically upward direction along an axial direction of the outer cylinder portion 35 of the pail pack 30, and the term "downward" described later means a vertically downward direction along the axial direction of the outer cylinder portion 35 of the pail pack 30.

A wire pressing plate 40 is placed on the laminated wire 50, and the laminated wire 50 is pressed downward by a weight of the wire pressing plate 40. An outer diameter of the wire pressing plate 40 is slightly smaller than an inner diameter of the outer cylinder portion 35, and the wire pressing plate 40 is movable inside the outer cylinder portion 35 in the axial direction of the outer cylinder portion 35.

On the other hand, an inner diameter of the wire pressing plate 40 is larger than an outer diameter of the inner cylinder 34, and a gap C1 for drawing out the welding wire W is provided between an inner peripheral end edge 40*a* of the wire pressing plate 40 and an outer peripheral surface of the inner cylinder 34. Since a size of the gap C1 is set to be larger than a diameter of the welding wire W, the welding wire W can be drawn out from between the wire pressing plate 40 and the inner cylinder 34. That is, the pail pack 30 shown in FIG. 3 is a so-called "interior drawer manner" pail pack.

As shown in FIG. 3, the kink prevention jig 10 is attached to the pail pack 30 by engaging the cylindrical portion 11 with the inner cylinder 34 of the pail pack 30. That is, the conical portion 12 is disposed in a substantially truncated conical internal space formed by the lid body 32 above the inner cylinder 34. Accordingly, the substantially truncated conical internal space formed by the lid body 32 is narrowed by the conical portion 12. That is, a space through which the welding wire W drawn out from the laminated wire 50 can pass is the substantially annular passage space S3 which is a portion obtained by subtracting a volume S2 of the conical portion 12 from the substantially truncated conical internal space formed inside the lid body 32. The diameter D2 of the bottom surface 13 of the conical portion 12 is smaller than the inner diameter of the outer cylinder portion 35, and a predetermined gap C2 set larger than the diameter of the welding wire W is provided between the outer peripheral edge 15 of the conical portion 12 and the inner peripheral surface of the outer cylinder portion 35 of the pail pack 30.

A height H3 from the bottom plate portion 33 of the housing 31 to a top portion 17 of the conical surface 16, which is a wire abutting portion, is preferably greater than H1+½× (H2−H1), where H1 is a height of the housing 31 and H2 is a height from the bottom plate portion 33 of the housing 31 to the draw-out opening 37. That is, H3>H1+½×(H2−H1) is preferred, H3>H1+⅝×(H2−H1) is more preferred, H3>H1+¾×(H2−H1) is further preferred, and H3>H1+⅞×(H2−H1) is particularly preferred. As the height H3 from the bottom plate portion 33 of the housing 31 to the top portion 17 of the conical surface 16 increases, the welding wire W can be guided along the jig to the vicinity of the draw-out opening 37, and thus the kink prevention effect is further enhanced.

Next, an operation of the pail pack 30 including the kink prevention jig 10 will be described. As shown in FIG. 3, the welding wire W drawn out from one end of the laminated wire 50 on an inner side (inner cylinder 34 side) in the pail pack 30 is led out to the outside of the pail pack 30 from the gap C1 provided between the inner peripheral end edge 40*a* of the wire pressing plate 40 and the outer peripheral surface of the inner cylinder 34, and further from the draw-out opening 37 of the cap 38 provided in the lid body 32.

The wire pressing plate 40 is moved downward as the welding wire W is drawn out and the height of the laminated wire 50 decreases.

The welding wire W drawn out from the laminated wire 50 passes through the gap C2 between the outer peripheral edge 15 of the conical portion 12 and the inner peripheral surface of the outer cylinder portion 35 of the pail pack 30 to come into sliding contact with the outer peripheral edge 15 of the conical portion 12, then is drawn out upward while being moved in a circumferential direction along the conical surface 16, and is led out to the passage space S3.

As a result of intensive studies by the present inventors, it has been found that, in the "interior drawer manner" pail pack 30 as shown in the present embodiment, twisting is accumulated in the welding wire W as the welding wire W is drawn out for a long time, so that the welding wire W laminated in a ring shape may rise upward so as to pass over the inner cylinder 34 while being in a ring shape. At this time, it was confirmed that, in the case of a related-art pail pack without a kink prevention jig, the ring-shaped welding wire W climbs over the inner cylinder 34 to cause a kink. On the other hand, in the kink prevention jig 10 according to the present embodiment, since the bottom surface 13 of the conical portion 12 blocks an upper side of the inner cylinder 34, even when the welding wire W goes around a side portion of the wire pressing plate 40 and comes out above the wire pressing plate 40 while being in a ring shape, the welding wire W coming out upward from the wire pressing plate 40 can be prevented from climbing over the inner cylinder 34 because the welding wire W abuts against the bottom surface 13 (outward extending portion 14) of the conical portion 12.

When twisting is further imparted to the welding wire W, the welding wire W is about to climb over the outward extending portion 14 to form a kink, but in the present embodiment, the conical surface 16 of the kink prevention jig 10 prevents the occurrence of the kink. Here, the inventors have found that when the welding wire W is about to form a kink above the inner cylinder 34, the welding wire W is twisted such that the welding wire W is directed toward a central axis of the outer cylinder portion 35 of the pail pack. Therefore, the kink prevention jig 10 is provided with the conical surface 16 that abuts against the welding wire W such that the welding wire W cannot form a kink. In the present embodiment, the space in the lid body 32 is preferably filled by 50% or more, more preferably 60% or more, still more preferably 70% or more, and particularly preferably 80% or more by the kink prevention jig 10.

The height H3 from the bottom plate portion 33 of the housing 31 to the top portion 17 of the conical surface 16, which is a wire abutting portion, is greater than H1+(H2−H1)×½, where H1 is the height of the housing 31 and H2 is the height from the bottom plate portion 33 of the housing 31 to the draw-out opening 37 for the welding wire W of the lid body 32. Therefore, the passage space S3 formed inside the lid body 32 is narrowed by the kink prevention jig 10. Since the passage space S3 is a narrow space having a substantially annular shape, even when the welding wire W is twisted in the passage space S3, formation of a kink can be prevented because the welding wire W interferes with the conical surface 16 of the conical portion 12, which is a wire abutting portion, and a free movement of the welding wire W is restricted. Then, the welding wire W passes through the draw-out opening 37 of the cap 38 and is led out to the outside of the pail pack 30.

In this way, a movement of the welding wire W drawn out from the laminated wire 50 is restricted at an upstream portion viewed from the laminated wire 50 by the gap C1 between the inner peripheral end edge 40*a* of the wire pressing plate 40 and the outer peripheral surface of the inner cylinder 34. The movement of the welding wire W is restricted at an intermediate portion viewed from the laminated wire 50 at the gap C2 by the outer peripheral edge 15 of the conical portion 12 which is in sliding contact with the welding wire W. Further, the movement of the welding wire W is restricted at a downstream portion viewed from the laminated wire 50 by the draw-out opening 37 of the cap 38. Since the free movement of the welding wire W is restricted at three positions of the upstream portion, the intermediate portion, and the downstream portion, and an occurrence of slack is effectively prevented, a kink is prevented from being formed in the welding wire W.

In the present embodiment, when the size of the gap C2 between the outer peripheral edge 15 of the conical portion 12 and the inner peripheral surface of the outer cylinder portion 35 of the pail pack 30 is equal to or less than 0.10 times as large as the inner diameter D3 of the outer cylinder portion 35, the effect of restricting the laminated wire 50 by the gap C2 can be further improved. As a result, the occurrence of slack in the welding wire W is effectively prevented, and the effect of preventing a kink from being formed in the welding wire W can be enhanced.

On the other hand, when the size of the gap C2 is equal to or more than 0.05 times as large as the inner diameter D3, it is possible to prevent the gap C2 from becoming too narrow and to secure wire feedability.

Therefore, the size of the gap C2 is preferably equal to or more than 0.05 times, and preferably equal to or less than 0.10 times as large as the inner diameter D3 of the outer cylinder portion 35.

In order to set a relationship between the size of the gap C2 and the inner diameter D3 of the outer cylinder portion 35 within the above range, for example, the diameter D2 of the outer peripheral edge 15 of the conical portion 12 in the kink prevention jig 10 may be set to be equal to or more than 0.80 times and equal to or less than 0.90 times as large as the inner diameter D3 of the outer cylinder portion 35.

As a result of intensive studies, the present inventors have found that there is a case where excessive twisting is accumulated in the welding wire W inside the pail pack 30 due to long-time welding, and in this case, the welding wire W is likely to cause a kink particularly above the cylindrical portion 11. Therefore, the kink prevention jig 10 described above eliminates the space required for the welding wire W to form a kink, thereby preventing the kink. That is, the kink prevention jig 10 acts as a wall to restrict the movement of the welding wire W, thereby preventing the kink.

A free movable weight (not shown) may be disposed above the wire pressing plate 40. The free movable weight has, for example, a spherical shape, and a through hole through which the welding wire W is inserted is formed in the free movable weight. A diameter of the free movable weight is set to be larger than that of the gap C1 between the inner peripheral end edge 40*a* of the wire pressing plate 40 and the inner cylinder 34, and an inner diameter of the through hole is set to be larger than that of the outer diameter of the welding wire W. When the welding wire W is drawn out from the laminated wire 50, the free movable weight revolves along the outer peripheral surface of the inner cylinder 34 while being in contact with the wire pressing plate 40 and the inner cylinder 34 above the gap C1. At this time, slack of the welding wire W is prevented by the free movable weight, thereby preventing the occurrence of a kink.

Figure 2B:
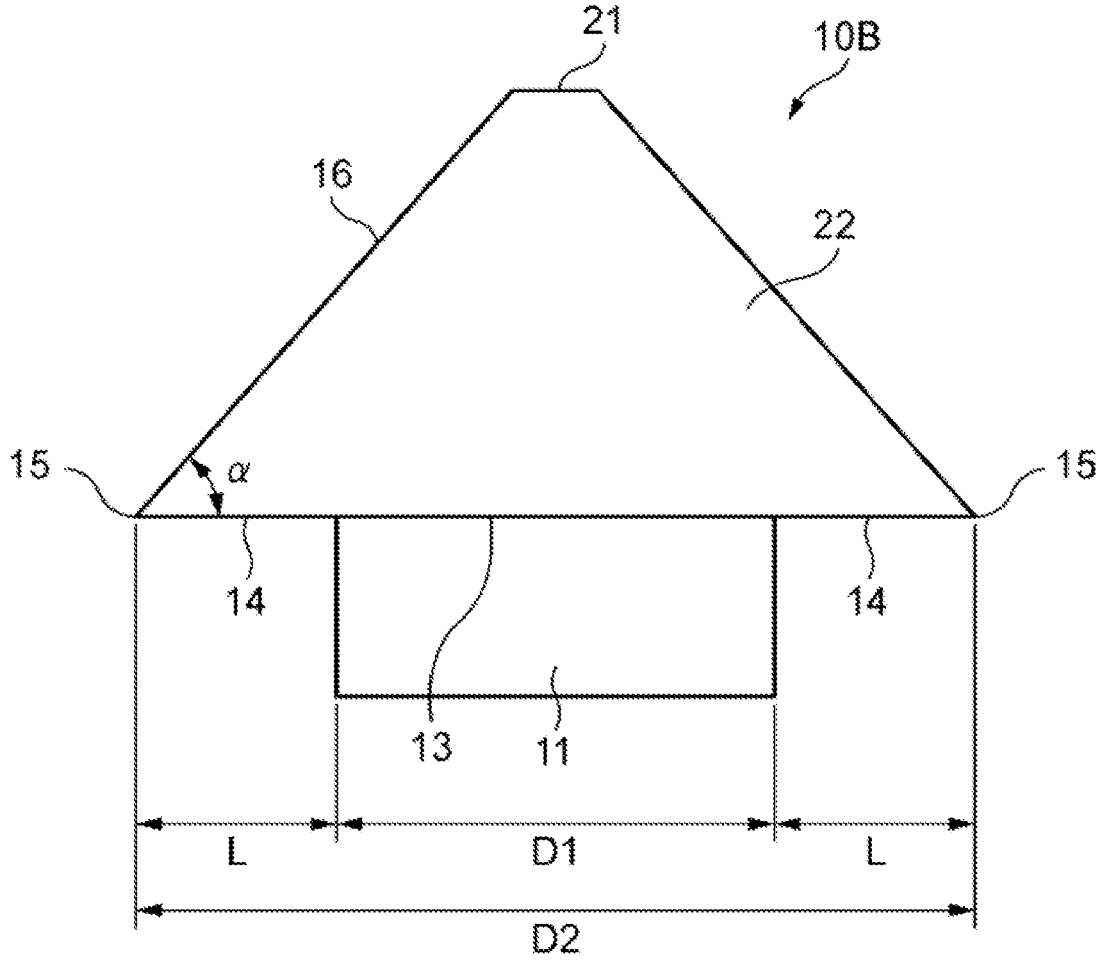
FIG. 2B is a side view showing a kink prevention jig according to another modification.

In the pail pack 30 including the kink prevention jig 10A according to the modification shown in FIGS. 2A and 2B, since the upper portion of the conical surface 16 of the kink prevention jig 10A is the truncated cone 22 having the flat surface 21 formed by being cut in parallel with the bottom surface 13, an angle α between the bottom surface 13 and the conical surface 16 is increased in a cross-sectional view in an up-down direction (vertical direction) of the kink prevention jig 10A when the height of the truncated cone 22 is set to a height same as that of the conical portion 12 of the kink prevention jig 10 according to the embodiment shown in FIG. 1. Therefore, since an inclination angle of the conical surface 16 is large, the passage space S3 formed inside the lid body 32 becomes narrower, and the effect of preventing a kink is enhanced. The angle α is not particularly limited, but in order to effectively exhibit kink prevention, the angle α of each of the kink prevention jig 10 shown in FIG. 1, the kink prevention jig 10A shown in FIG. 2A, and the kink prevention jig 10B shown in FIG. 2B is preferably 30° or more, more preferably 40° or more, still more preferably 45° or more, and particularly preferably 55° or more. Here, the angle α is an angle directed upward with respect to the horizontal direction. An upper limit of the angle α is not particularly limited, and is, for example, 75° or less or 65° or less.

Second Embodiment

Figure 4:
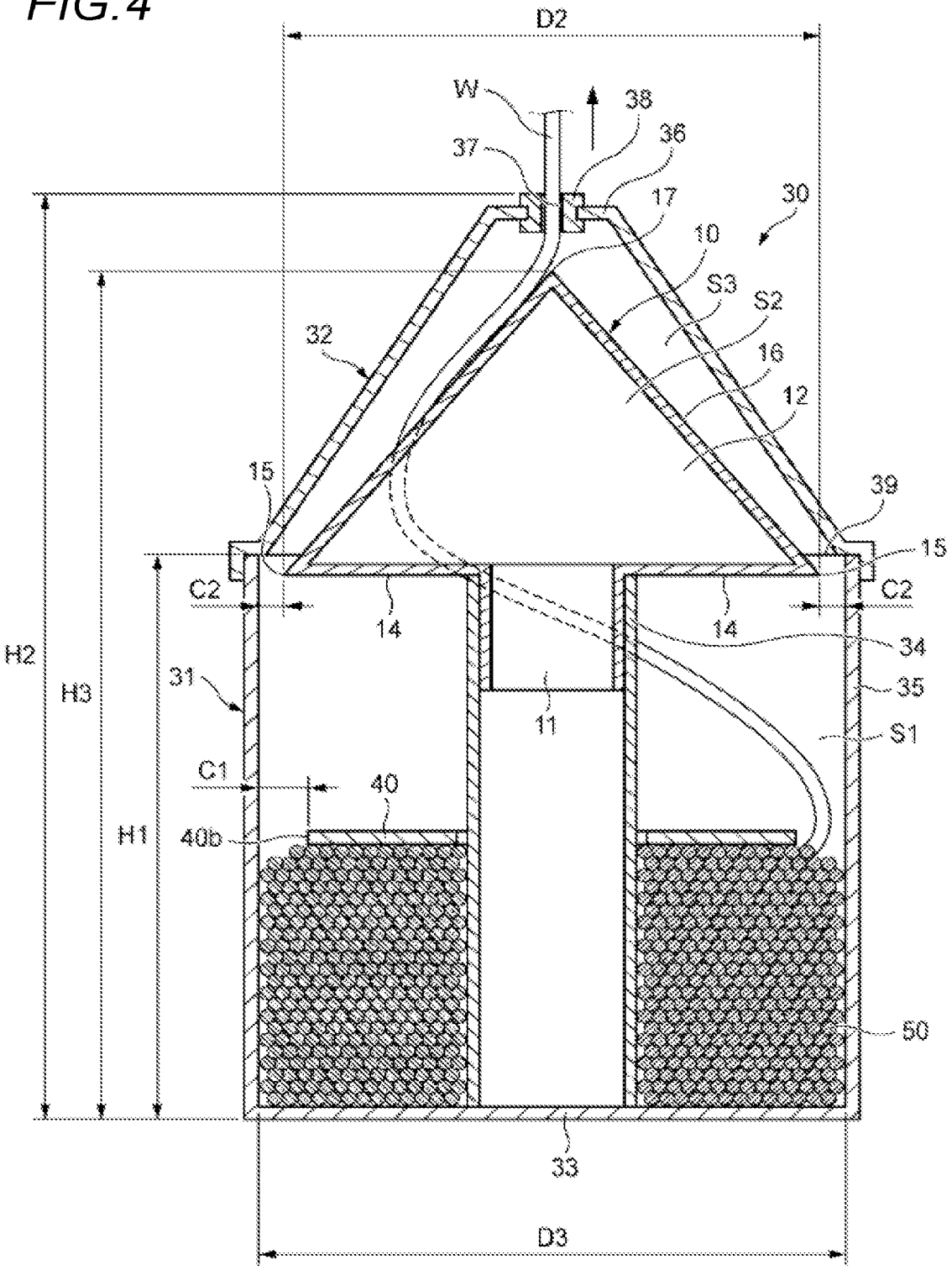
FIG. 4 is a cross-sectional view showing a pail pack according to a second embodiment of the present invention.

As shown in FIG. 4, the pail pack 30 according to a second embodiment is a so-called "exterior drawer manner" pail pack 30, and includes the housing 31 and the lid body 32 provided so as to cover the opening portion 39 in an upper portion of the housing 31, similar to the kink prevention jig 10 according to the first embodiment. The housing 31 includes the inner cylinder 34 and the outer cylinder portion 35 that are coaxially disposed on the bottom plate portion 33, and the laminated wire 50 formed by winding the welding wire W is accommodated between the inner cylinder 34 and the outer cylinder portion 35.

The lid body 32 is formed in a substantially truncated cone shape with an outer diameter gradually decreasing upward, and the cap 38 having a draw-out opening 37 from which the welding wire W is drawn out is fixed to the top portion 36 of the lid body 32. That is, the housing 31 forms the accommodation space S1 for accommodating the laminated wire 50 therein, and the lid body 32 forms the passage space S3 having a substantially truncated cone shape therein.

The annular wire pressing plate 40 is placed on the laminated wire 50, and the laminated wire 50 is pressed downward by a weight of the wire pressing plate 40. An outer diameter of the wire pressing plate 40 is smaller than an inner diameter of the outer cylinder portion 35, and the gap C1 for drawing out the welding wire W is provided between an outer peripheral end edge 40*b* of the wire pressing plate 40 and an inner peripheral surface of the outer cylinder portion 35. A size of the gap C1 is set to be larger than an outer diameter of the welding wire W.

Similar to the first embodiment, the kink prevention jig 10 is attached to the pail pack 30 by engaging the cylindrical portion 11 with the inner cylinder 34 of the pail pack 30. Accordingly, a substantially truncated conical internal space formed by the lid body 32 is narrowed by the conical portion 12, and a space through which the welding wire W drawn out from the laminated wire 50 can pass is the passage space S3 which is a portion obtained by subtracting the volume S2 of the conical portion 12 from the substantially truncated conical internal space formed inside the lid body 32. The diameter D2 of the bottom surface 13 of the conical portion 12 is smaller than an inner diameter of the outer cylinder portion 35, and the gap C2 is provided between the outer peripheral edge 15 of the conical portion 12 and the inner peripheral surface of the outer cylinder portion 35 of the pail pack 30.

Similarly, in the present embodiment, the height H3 of the top portion 17 of the conical surface 16, which is a wire abutting portion, is set to be greater than $H1+(H2-H1)\times 1/2$, where H1 is the height of the housing 31 and H2 is the height of the draw-out opening 37 for the welding wire W of the lid body 32.

The welding wire W drawn out from one end of the laminated wire 50 on an outer diameter side (that is, the outer cylinder portion 35 side) is drawn out upward from the gap C1 between the outer peripheral end edge 40*b* of the wire pressing plate 40 and the inner peripheral surface of the outer cylinder portion 35, and is further led out to the outside of the pail pack 30 from the draw-out opening 37 of the cap 38 provided in the lid body 32.

The wire pressing plate 40 is moved downward as the welding wire W is drawn out and the height of the laminated wire 50 decreases.

The welding wire W drawn out from the laminated wire 50 and drawn out to the accommodation space S1 passes through the gap C2 between the outer peripheral edge 15 of the conical portion 12 and the inner peripheral surface of the outer cylinder portion 35 of the pail pack 30 to come into sliding contact with the outer peripheral edge 15 of the conical portion 12, then is drawn out upward while being moved in a circumferential direction along the outer peripheral edge 15, and is led out to the passage space S3.

The height H3 from the bottom plate portion 33 of the housing 31 to the top portion 17 of the conical surface 16, which is a wire abutting portion, is greater than H1+(H2−H1)×½, where H1 is the height of the housing 31 and H2 is the height from the bottom plate portion 33 of the housing 31 to the draw-out opening 37 for the welding wire W of the lid body 32. Therefore, the passage space S3 formed inside the lid body 32 is narrowed by the kink prevention jig 10. Since the passage space S3 is a substantially annular narrow space, even when the welding wire W is about to be twisted and entangled in the passage space S3, entanglement can be prevented because the welding wire W interferes with the conical surface 16 of the conical portion 12, which is a wire abutting portion, and a free movement of the welding wire W is restricted. Then, the welding wire W passes through the draw-out opening 37 of the cap 38 and is led out to the outside of the pail pack 30.

In this way, a movement of the welding wire W drawn out from the laminated wire 50 is restricted at an upstream portion viewed from the laminated wire 50 by the gap C1 between the outer peripheral end edge 40*b* of the wire pressing plate 40 and the inner peripheral surface of the outer cylinder portion 35, the movement of the welding wire W is restricted at an intermediate portion viewed from the laminated wire 50 by the gap C2 by the outer peripheral edge 15 of the conical portion 12 which is in sliding contact with the welding wire W, and the movement of the welding wire W is restricted at a downstream portion viewed from the laminated wire 50 by the draw-out opening 37 of the cap 38. Since the free movement of the welding wire W is restricted at three positions of the upstream portion, the intermediate portion, and the downstream portion, and an occurrence of slack is effectively prevented, the welding wire W is prevented from being entangled as in the first embodiment.

Similarly, in the second embodiment, a size of the gap C2 between the outer peripheral edge 15 of the conical portion 12 and the inner peripheral surface of the outer cylinder portion 35 of the pail pack 30 is preferably equal to or more than 0.05 times and preferably equal to or less than 0.10 times as large as the inner diameter D3 of the outer cylinder portion 35.

In order to set a relationship between the size of the gap C2 and the inner diameter D3 of the outer cylinder portion 35 within the above range, the diameter D2 of the outer peripheral edge 15 of the conical portion 12 in the kink prevention jig 10 may be set to be equal to or more than 0.80 times and equal to or less than 0.90 times as large as the inner diameter D3 of the outer cylinder portion 35.

Third Embodiment

Figure 5:
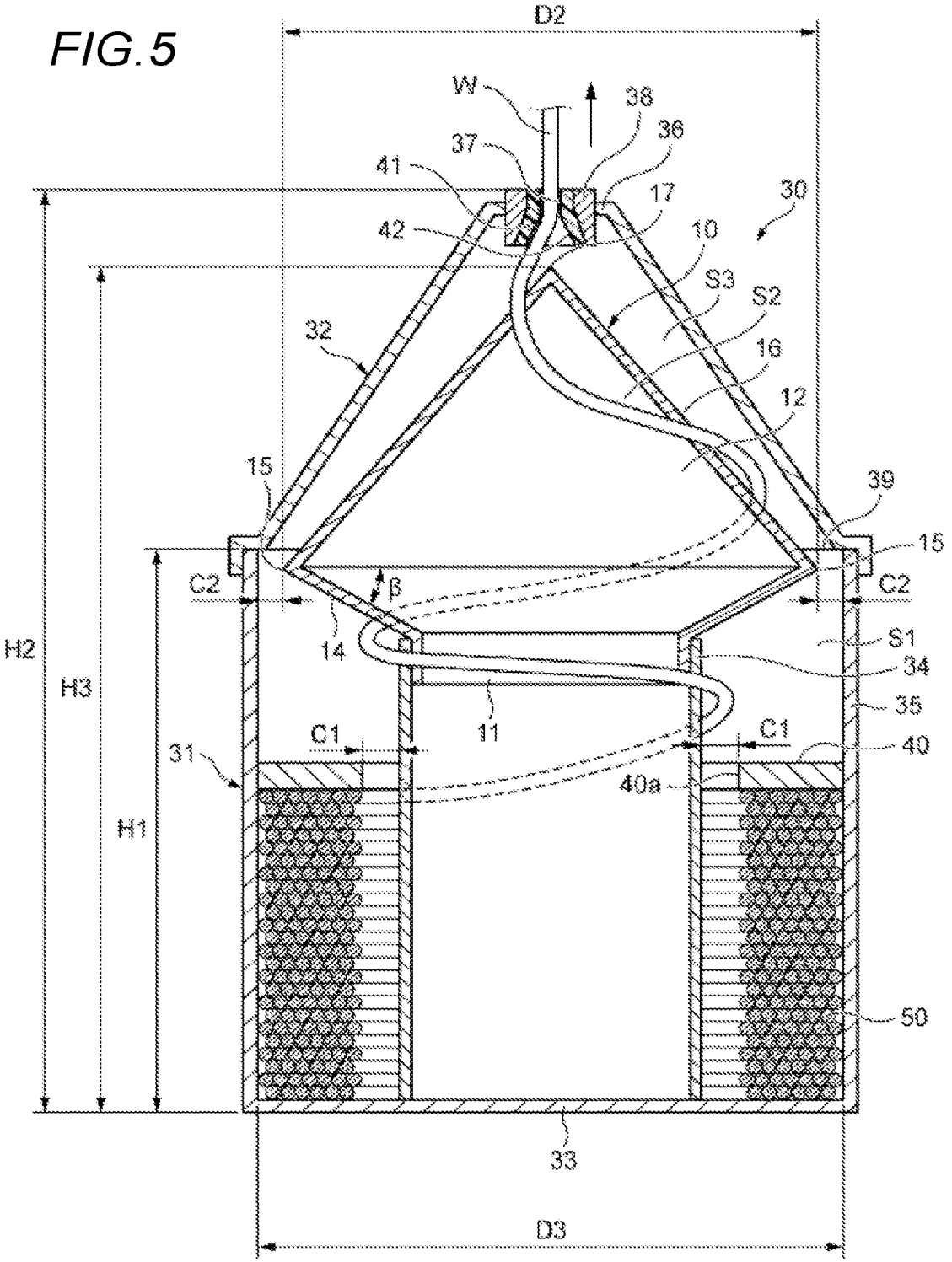
FIG. 5 is a cross-sectional view showing a pail pack according to a third embodiment of the present invention.

FIG. 5 is a cross-sectional view showing a pail pack according to a third embodiment of the present invention. As shown in FIG. 5, the pail pack 30 according to the third embodiment is an "interior drawer manner" pail pack and is a modification of the first embodiment, and therefore, in FIG. 5, the description of the same or equivalent parts as those of the first embodiment shown in FIG. 3 will be omitted or simplified.

In the pail pack 30 according to the third embodiment, the outward extending portion 14 of the conical portion 12 has a shape extending obliquely upward from the cylindrical portion 11 toward the outer peripheral edge 15. An angle β shown in FIG. 5 is an angle formed by a horizontal direction and an extending direction of the outward extending portion 14 in a cross-sectional view of the pail pack.

In this way, when the outward extending portion 14 of the conical portion 12 has a shape extending obliquely upward from the cylindrical portion 11 toward the outer peripheral edge 15, both an effect of preventing the wire W from floating up and an effect of improving wire feedability can be improved. In particular, when the angle β is 400 or less, the wire W can be prevented from floating up by the outward extending portion 14, and the wire feedability is improved. Therefore, the angle β is preferably 40° or less, more preferably 30° or less, and still more preferably 20° or less.

As described above, the angle β may be negative, that is, the outward extending portion 14 of the conical portion 12 may have a shape extending obliquely downward from the cylindrical portion 11 toward the outer peripheral edge 15. The angle β is preferably 0° or more in order to secure the wire feedability. The angle β is more preferably 0° or more and 10° or less for the reason that the kink prevention jig 10 can be easily manufactured.

Similar to the first embodiment, the lid body 32 of the pail pack 30 is formed in a substantially truncated cone shape with an outer diameter gradually decreasing upward, and the cap 38 including the draw-out opening 37 from which the wire W is drawn out is fixed to the top portion 36 of the lid body 32. A plastic-made pipe 41 is disposed on an inner surface side of the cap 38 with which the wire W comes into contact, and a wire lead-in opening 42 radially expanding toward the passage space S3 is formed in the pipe 41.

In this way, when the pipe 41 disposed on the cap 38 radially expands downward, i.e., toward the passage space S3, the wire W is easily led from the passage space S3, the wire is unlikely to be curled, and thus the feedability can be improved.

A material of the pipe 41 is preferably a material capable of preventing a wear and an occurrence of scrap metal due to sliding between the pipe 41 and the wire W. and is preferably, for example, plastic, or ceramic.

When the pipe 41 including the wire lead-in opening 42 is made of a material capable of preventing a wear or the like due to sliding with the wire W, the occurrence of scrap metal can be prevented, and thus an occurrence of feeding failure or the like due to accumulation of scrap metal can be prevented.

The present invention is not limited to the embodiments described above, and modifications, improvements, and the like can be made as appropriate.

Figure 6A:
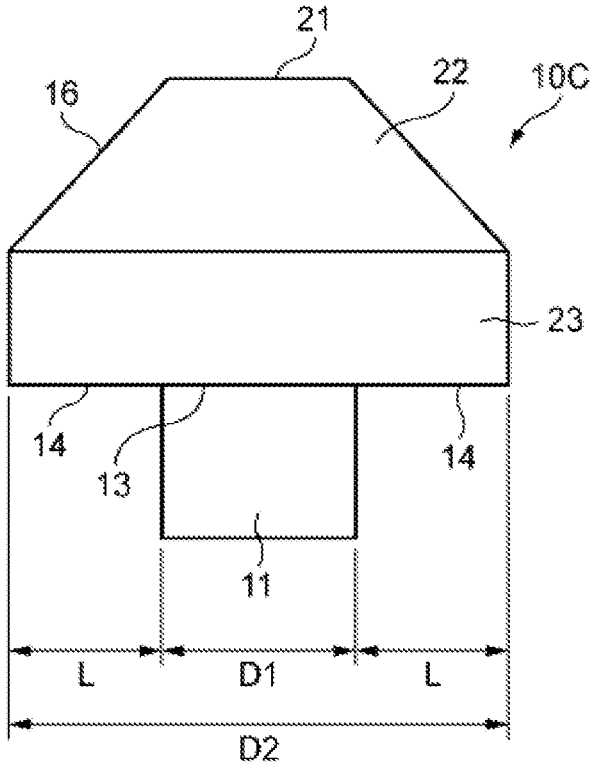
FIG. 6A is a side view showing a kink prevention jig according to still another modification.

For example, as a kink prevention jig 10C according to still another modification, as shown in FIG. 6A, a shape of a portion corresponding to the conical portion 12 in FIG. 1 may be a combination of the cylindrical portion 23 and the truncated cone 22.

Figure 6B:
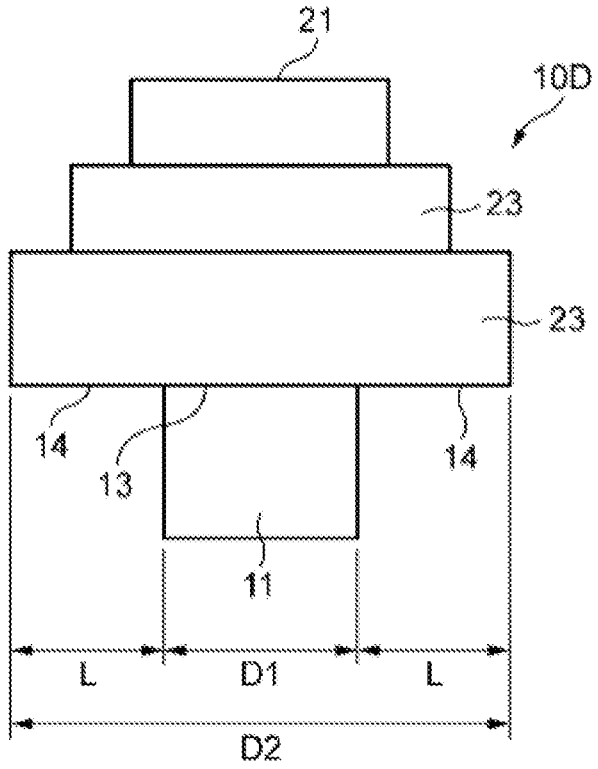
FIG. 6B is a side view showing a kink prevention jig according to further another modification.

As shown in FIG. 6B, as a kink prevention jig 10D according to further another modification, a plurality of cylindrical portions 23 with an outer diameter gradually decreasing upward may be combined.

Figure 6C:
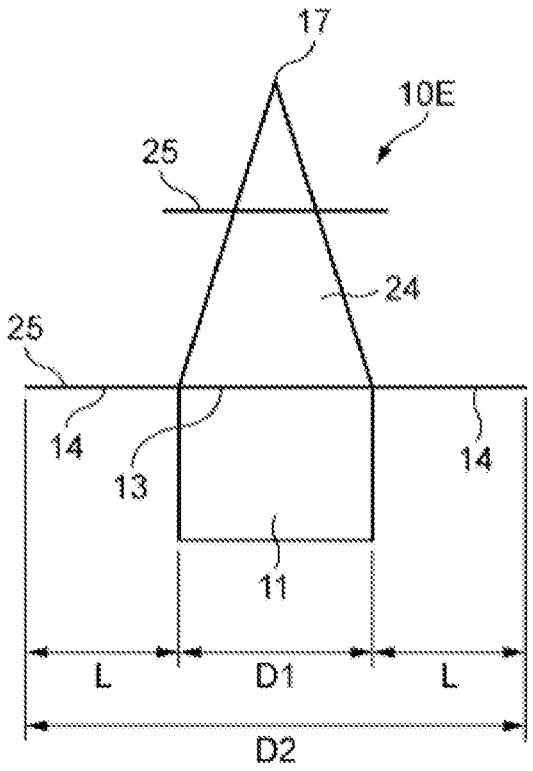
FIG. 6C is a side view of a kink prevention jig according to yet another modification.
Figure 6D:
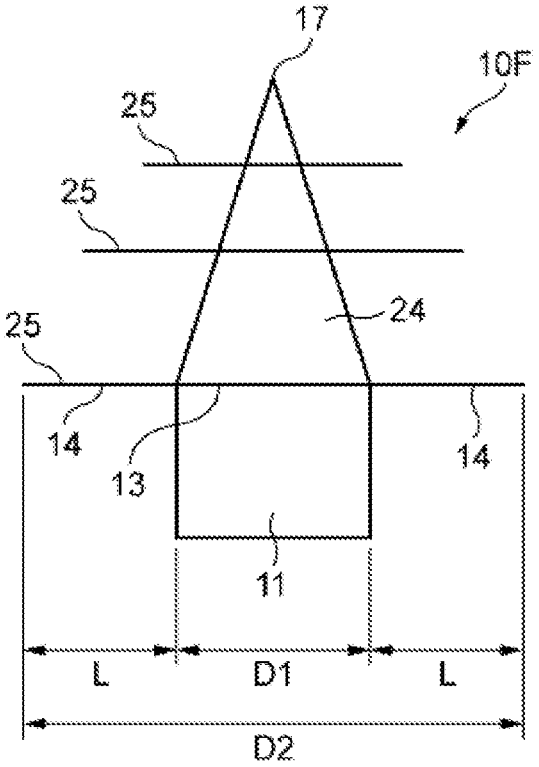
FIG. 6D is a side view of a kink prevention jig according to still further another modification.

Further, as kink prevention jigs 10E and 10F according to other modifications, as shown in FIGS. 6C and 6D, respectively, a plurality of holed disks 25 are provided that are engaged with and fixed to a support column 24 that is formed so as to protrude upward from the cylindrical portion 11 that engages with the inner cylinder 34 of the pail pack 30.

In this case, the outer peripheral edge of each disk 25 acts as a wire abutting portion that guides the welding wire W. and prevents the welding wire W from being entangled. In FIGS. 6C and 6D, the support column 24 has a conical shape, but the present invention is not limited thereto.

Figure 6E:
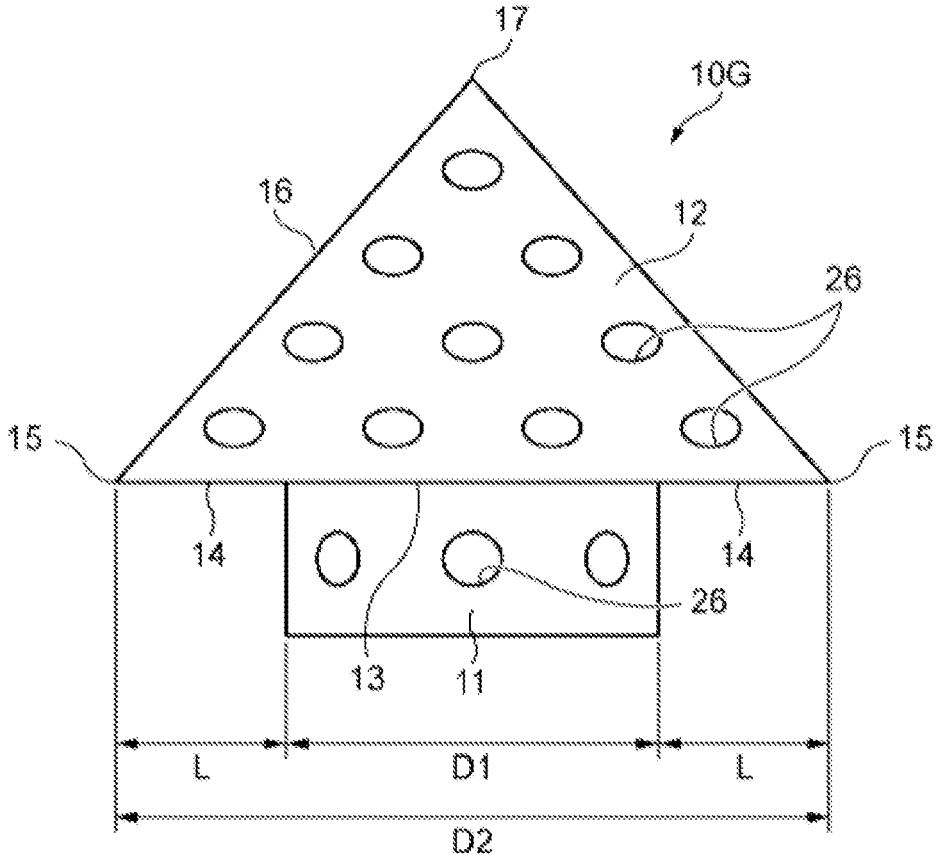
FIG. 6E is a side view of a kink prevention jig according to still yet another modification.

Further, as a kink prevention jig 10G according to still further another modification, as shown in FIG. 6E, a plurality of holes 26 may be formed in the cylindrical portion 11, the conical portion 12, or the like to reduce the weight.

Although various embodiments have been described above with reference to the drawings, it is needless to say that the present disclosure is not limited to such examples. It will be apparent to those skilled in the art that various alterations, modifications can be conceived within the scope of the claims, and it should be understood that they also belong to the technical scope of the present disclosure. Each component in the various embodiments described above may be combined arbitrarily in the range without deviating from the spirit of the invention.

The present application is based on a Japanese Patent Application (Patent Application No. 2020-151376) filed on Sep. 9, 2020, the contents of which are incorporated herein by reference.

REFERENCE SIGNS LIST

10, 10A to 10G Kink prevention jig
11 Cylindrical portion (connecting portion)
12 Conical portion
13 Bottom surface
14 Outward extending portion
15 Outer peripheral edge
16 Conical surface (wire abutting portion)
17 Top portion (of conical surface)
21 Flat surface
22 Truncated cone
30 Pail pack
31 Housing
32 Lid body
33 Bottom plate portion
34 Inner cylinder
35 Outer cylinder portion
36 Top portion (of lid body)
37 Draw-out opening
39 Opening portion
40 Wire pressing plate
50 Laminated wire
H1 Height of housing
H2 Height of draw-out opening
H3: Height of top portion of wire abutting portion
S1 Accommodation space
S2 Volume of conical portion 12
S3 Passage space
W Welding wire

The invention claimed is:

1. A kink prevention jig for a pail pack, the pail pack comprising a housing to accommodate a laminated wire, the housing including a bottom plate portion and an outer cylinder portion and a draw-out opening for a wire at an upper side wherein the kink prevention jig comprises:

an outward extending portion provided above a laminated wire and extending in a radial direction of the outer cylinder portion, and a wire abutting portion formed above the outward extending portion so that the wire abutting portion abuts against a wire to prevent occurrence of a kink when the wire is drawn out from the draw-out opening, wherein a top portion of the wire abutting portion is located at a height greater than $H1+\frac{1}{2}\times(H2-H1)$, where H1 is a height of the housing and H2 is a height of the draw-out opening, and wherein a size of a gap between an outer peripheral edge of the wire abutting portion and the outer cylinder portion is 0.05 times or more and 0.10 times or less with respect of an inner diameter of the outer cylinder portion.

2. The kink prevention jig according to claim 1, wherein the pail pack includes, in the housing, an inner cylinder provided on an inner side of the laminated wire in a coil shape, and wherein the kink prevention jig has a connecting portion extending downward from the outward extending portion to engage with the inner cylinder.

3. The kink prevention jig according to claim 2, wherein the wire abutting portion is formed in a substantially conical shape.

4. The kink prevention jig according to claim 1, wherein the wire abutting portion is formed in a substantially conical shape.

5. A pail pack comprising the kink prevention jig according to claim 3, further comprising:

a lid body provided to cover an opening portion opposite to the bottom plate portion in the housing, wherein the lid body has a substantially conical shape with an outer diameter gradually decreasing upward.

6. A pail pack comprising the kink prevention jig according to claim 2, further comprising:

a pressing plate configured to press the laminated wire downward, wherein the pail pack is configured such that the laminated wire is drawn out in an interior drawer manner.

7. A pail pack comprising the kink prevention jig according to claim 2, further comprising:

a lid body provided to cover an opening portion opposite to the bottom plate portion in the housing, wherein the lid body has a substantially conical shape with an outer diameter gradually decreasing upward.

8. A pail pack comprising the kink prevention jig according to claim 4, further comprising:

a lid body provided to cover an opening portion opposite to the bottom plate portion in the housing, wherein the lid body has a substantially conical shape with an outer diameter gradually decreasing upward.

9. A pail pack comprising the kink prevention jig according to claim 1, further comprising:

a pressing plate configured to press the laminated wire downward, wherein the pail pack is configured such that the laminated wire is drawn out in an interior drawer manner.

10. A pail pack comprising the kink prevention jig according to claim 1, further comprising:

a lid body provided to cover an opening portion opposite to the bottom plate portion in the housing, wherein the lid body has a substantially conical shape with an outer diameter gradually decreasing upward.

* * * * *